US005901657A

United States Patent [19]

Schwartz

[11] Patent Number: 5,901,657

[45] Date of Patent: May 11, 1999

[54] SUPPORT STRUCTURE FOR PROTECTIVE COVER FOR BOATS

[76] Inventor: Thomas L. Schwartz, 30 Shannon Glen, Fairport, N.Y. 14450

[21] Appl. No.: 08/889,777

[22] Filed: Jul. 8, 1997

[51] Int. Cl.[6] ..... B63B 17/00

[52] U.S. Cl. ..... 114/361

[58] Field of Search ..... 114/343, 361; 135/88.01–88.03, 114

[56] References Cited

U.S. PATENT DOCUMENTS

| | | | |
|---|---|---|---|
| 804,154 | 11/1905 | Morse . | |
| 2,536,152 | 1/1951 | Bass . | |
| 2,542,586 | 2/1951 | Skjeveland . | |
| 3,059,659 | 10/1962 | Ipsen | 135/88.01 |
| 4,247,509 | 1/1981 | Talbot . | |
| 4,800,909 | 1/1989 | Seidel et al. . | |
| 4,979,457 | 12/1990 | Sommerhauser et al. . | |
| 5,277,391 | 1/1994 | Haug et al. . | |
| 5,479,872 | 1/1996 | Hulett . | |
| 5,487,402 | 1/1996 | Clary . | |
| 5,522,413 | 6/1996 | Kuwahara | 135/88.01 |

*Primary Examiner*—Ed L. Swinehart
*Attorney, Agent, or Firm*—Cumpston & Shaw

[57] ABSTRACT

A support structure for a flexible boat cover includes an extensible bar supported entirely by at least one cord extending therefrom to cleats located at the bow and stern of the boat. This invention provides multiple supports spaced laterally from the centerline of the boat without any additional hardware. The cord preferably elastic, may extend over the top of the windshield to provide an inclined support structure to prevent collection of water in the boat cover. The bar is extensible to accommodate boats of various widths and to reduce its length for storage when not in use. Additionally, the bar can be supported by posts underneath to support ice and snow in colder climates during the winter.

21 Claims, 7 Drawing Sheets

SUPPORT STRUCTURE FOR PROTECTIVE COVER FOR BOATS

FIELD OF INVENTION

The present invention relates generally to boats and to supports for boat covers comprised of flexible sheets.

BACKGROUND OF THE INVENTION

Boats having open cockpits are susceptible to water damage and damage due to direct sunlight unless covered when not in use. Typically, these covers are comprised of flexible fabric sheets which extend over the cockpit of the boat. Unfortunately, due to the stretching of the material, and they can sag and collect water, which further stretches the material, which causes further sagging, ultimately resulting in the failure of the cover. The present invention alleviates this problem by providing a firm support underneath the cover without requiring modification to the boat or risking damage to the boat.

To prevent the failure of the cover, various apparatuses have been invented to support the cover to prevent sagging. U.S. Pat. No. 5,479,872 to Hulett, for example, provides two extensible poles extending from the center of the bow of the boat to the center of the stern. The flexible cover is then draped over these poles and the windshield to protect the interior of the boat. The problem with this device is that for wider boats or boats with low profile windshields, the cover is still susceptible to collecting water between the poles and the sides of the boat.

U.S. Pat. No. 4,979,457 to Sommerhauser et al. provides three parallel extensible poles which extend from the stern of the boat to the top of the windshield. The problem with this apparatus is that it is heavy and bulky and complicated to set up.

U.S. Pat. No. 4,247,509 to Talbot provides one or more bridge straps extending from bow to stern attached at each end with the boat being draped by a single plastic film. This method requires the installation of additional hardware to tie down the straps.

U.S. Pat. Nos. 2,536,152 and 2,542,586 to Bass and Skjeveland, respectively, each employ a plurality of support structures placed along the length of the boat, each of which extends from either side of the boat upwards to an apex over the centerline of the boat.

These aforementioned patents have the drawback that they either require the installation of additional hardware or are unstable. In addition, they are cumbersome to set up and inconvenient to store when not in use.

SUMMARY OF THE INVENTION

The present invention overcomes the disadvantages of the prior art by providing a firm support for a boat cover which extends laterally as well as longitudinally, without requiring installation of additional hardware to the boat.

The central feature of the invention is a transversely disposed extensible bar from which at least one cord is releasably attached and extends to at least one tie-down cleat at the bow and stern of the boat. The bar functions to separate the cord so that the cover is supported not just along the center of the boat, but along multiple lateral positions as well, thereby preventing the cover from sagging and collecting water.

Since the bar is suspended entirely by the cord there is no need to install additional hardware to support the bar, and there is no risk of damaging the boat by marring its finish when installing or removing the apparatus.

DETAILED DESCRIPTION OF THE PREFERRED EMBODIMENT

Figure 1:
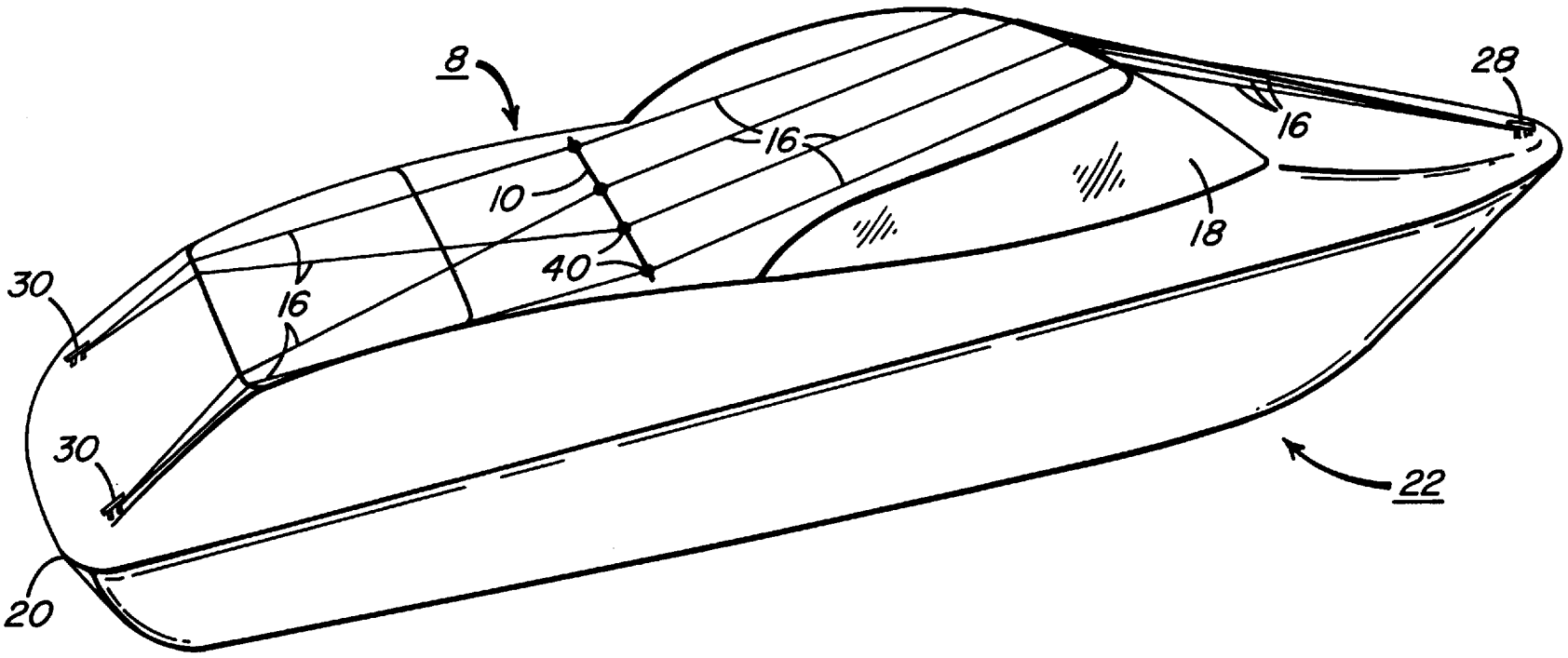
FIG. 1 shows a boat having the invention installed thereon.

As can be seen in FIG. 1, the invention comprises generally a support structure 8 comprising a transverse extensible bar 10 which is entirely supported by at least one cord 16, preferably elastic or shock cords, more commonly known as BUNGEE™ cords. The extensible bar 10 is positioned between the windshield 18 and the stern 20 of a boat 22, advantageously over the open cockpit of the boat, spanning the width or beam of the boat. The extensible bar 10 may be comprised of wood, metal or plastic, preferably aluminum. To adjust to various size boats, the extensible bar 10 is preferably comprised of at least two sections, such as a first coaxial tube section 12 and a second coaxial tube section 14 shown in FIGS. 2 and 3. First tube section 12 is of slightly smaller diameter than second tube section 14 and slides in second tube section 14 as shown. As an illustrative example only, tube section 12 is preferably ⅝" diameter while tube section 14 is preferably ¾" diameter. When bar 10 is at the desired length, a locking mechanism, preferably a set screw or thumb screw 26, is tightened through an adjustable collar 27, locking tubes 12 and 14 together in a fixed relationship.

At least one elastic cord 16, preferably two cords of equal length, is formed into loops and is removeably attached to the extensible bar 10 and to at least one cleat 28 at the bow of the boat and at least one cleat 30 at the stern of the boat. The cleats 28 may also be eyelets or other suitable equivalent fasteners. Multiple lengths of elastic cord 16 may extend from the bow to the stern of the boat. The windshield 18 of the boat can provide for an incline structure for the network of cords. In this way, the network of cords 16 and extensible bar 10 provide an inclined support structure. This inclined support structure supports a flexible cover (not shown) which will not collect water, but allow water to run off instead. In this manner, the transverse bar 10, suspended entirely by elastic cords having a sufficient length to extend to a bow and a stern of a boat, is maintained across the width or beam of the boat.

Figure 2:
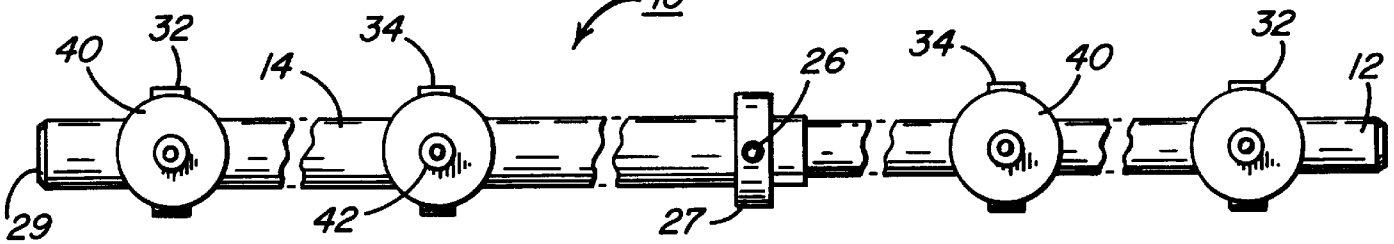
FIG. 2 shows the transverse bar assembly and portions thereof.
Figure 3:
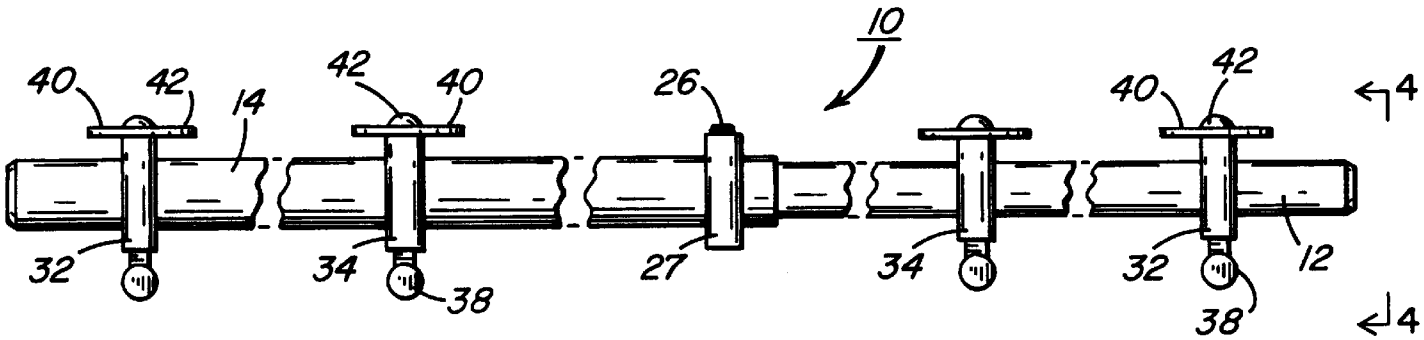
FIG. 3 shows the transverse bar assembly and portions thereof.
Figure 4:
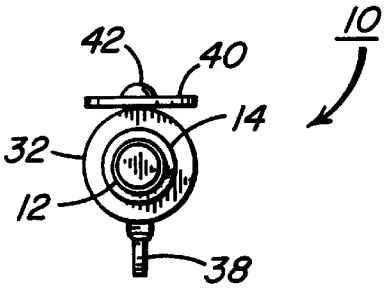
FIG. 4 illustrates an end view of the bar.

FIGS. 2 and 3 show a close up view of transverse extensible bar 10. Bar 10 includes a plurality of collars, preferably two end collars 32 and two inner collars 34 to which loops of elastic cord 16 are removably attached. The collars are spaced apart from one another and spaced apart from each end of the bar 10. Inner collars 34 are adjustable relative to the end collars 32. End collars 32 and inner collars 34 are shown in detail in FIGS. 2, 3 and 4. Each collar 32 and 34 is preferably comprised of aluminum, has a diameter slightly larger than the corresponding section 12 or 14 of bar 10 and encircles bar 10. The collars include a tapped aperture in which a fastener 38, such as a thumb screw, set screw, or nut, is inserted and securely attaches the collars to the bar 10. Preferably, the inner collar 34 is adjustably secured with a thumb screw while the outer collar is secured with a set screw. The collars 32 and 34 include a holder 40, such as a washer, knob, cleat or other suitable apparatus to securely hold the cords to the collar placements. The holder 40 is preferably attached to the collar by a screw 42. The holder 40 prevents the lateral movement of adjacent longitudinal portions of the elastic cords 16 along a length of the bar 10. The ends of the hollow bar 10 may be fitted with protective and decorative caps 29 to protect from injury or damage and for aesthetic purposes. FIG. 4 illustrates an end view of the bar 10 with a collar 32, fastener 38, washer 40 and screw 42.

Figure 5:
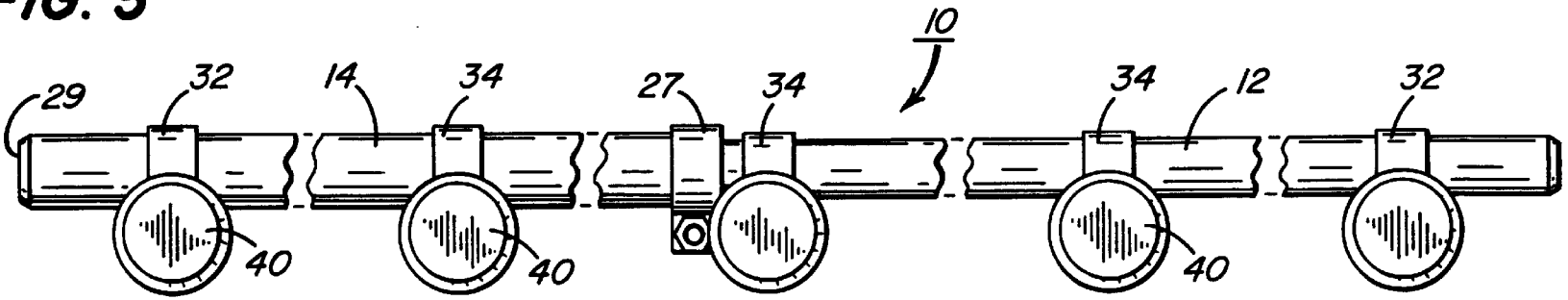
FIG. 5 illustrates an alternative embodiment.
Figure 6:
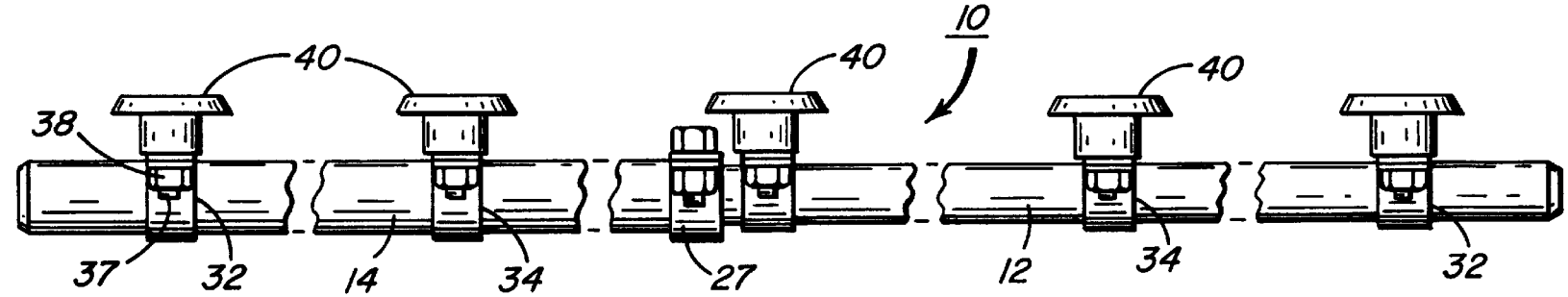
FIG. 6 is a side view of the alternative embodiment of FIG. 5.
Figure 7:
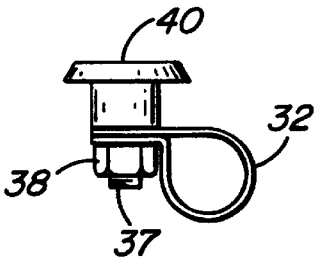
FIG. 7 illustrates an alternate collar assembly.

FIGS. 5, 6, and 7 illustrate an alternative embodiment in which the holder 40 is a enlarged head or knob having a threaded post 37. The collars 32 and 34 are straps bent to form a loop which fits around the bar 10. The post 37 is inserted through the apertures of the collars (not shown) onto which a fastener 38, such as a nut, is attached to securely hold the collar onto the bar 10.

Figure 12:
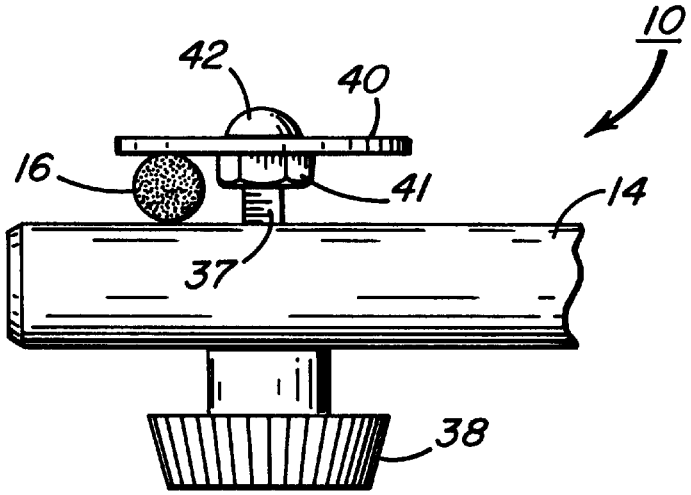
FIG. 12 illustrates a further alternative fastener assembly.

FIG. 12 illustrates an alternative embodiment in which collars are not employed. Preferably, this alternative embodiment may be used in place of the end collars. Washer 40 and nut 41 are threaded onto the post 37 of screw 42. The post is inserted through apertures (not shown) in bar 10. A fastener 38, preferably an enlarged knob, is threadingly attached to post 37 and contacts the bar 10. The fastener 38 is turned to pull the post through the apertures in the bar 10. A cord 16 may be inserted between the washer and the bar 10. By turning the fastener 38, the cord may be securely attached between the washer and bar.

Figure 8:
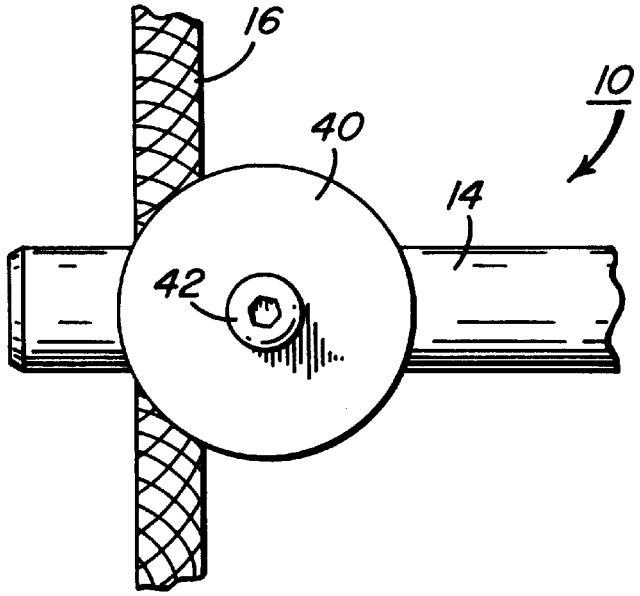
FIG. 8 illustrates a top view of a cord attached between a collar and the bar.
Figure 9:
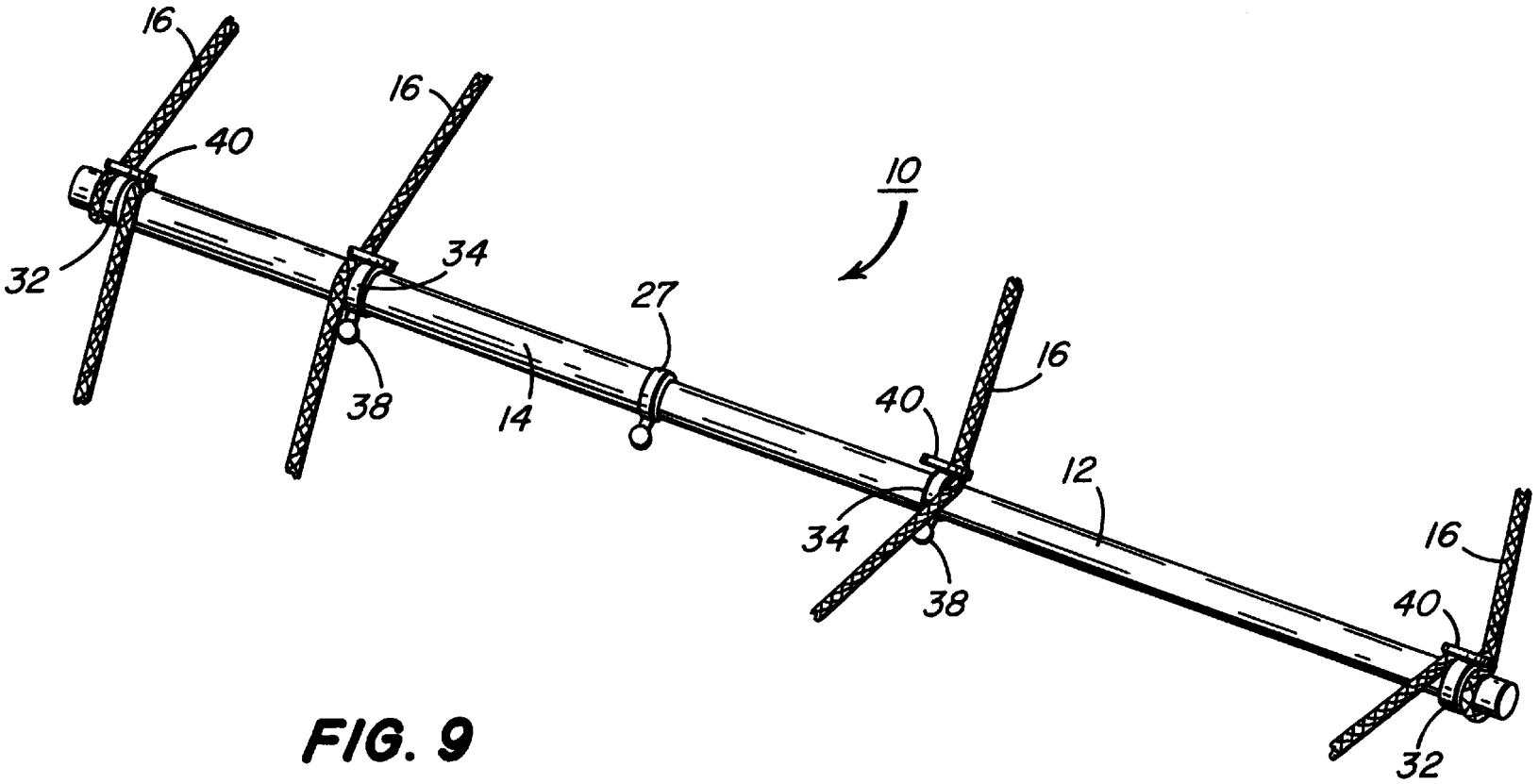
FIG. 9 illustrates the cords attached to the bar and collars.

The initial step in the installation of the support structure is to form the respective cords 16 into loops. Each loop of elastic cord is stretched over at least one respective bow cleat and stern cleat. The elastic cord is removably installed or attached onto the end collars 32. The remaining lengths of elastic cord, preferably two, are removeably attached to the adjustable inner collars 34. (See FIG. 6) The cords may be looped around the collar and between the washer 40 and bar 10 by any suitable means. However, the cords are preferably tucked between the washer 40 and the bar 10 when held in place on the inner collars 34 (see FIG. 8) and wound around the bar 10, crisscrossing the collar 32 beneath the washer 40 on the end collar 32 (see FIG. 9).

Figures 10A, 10B, 10C, 10D:
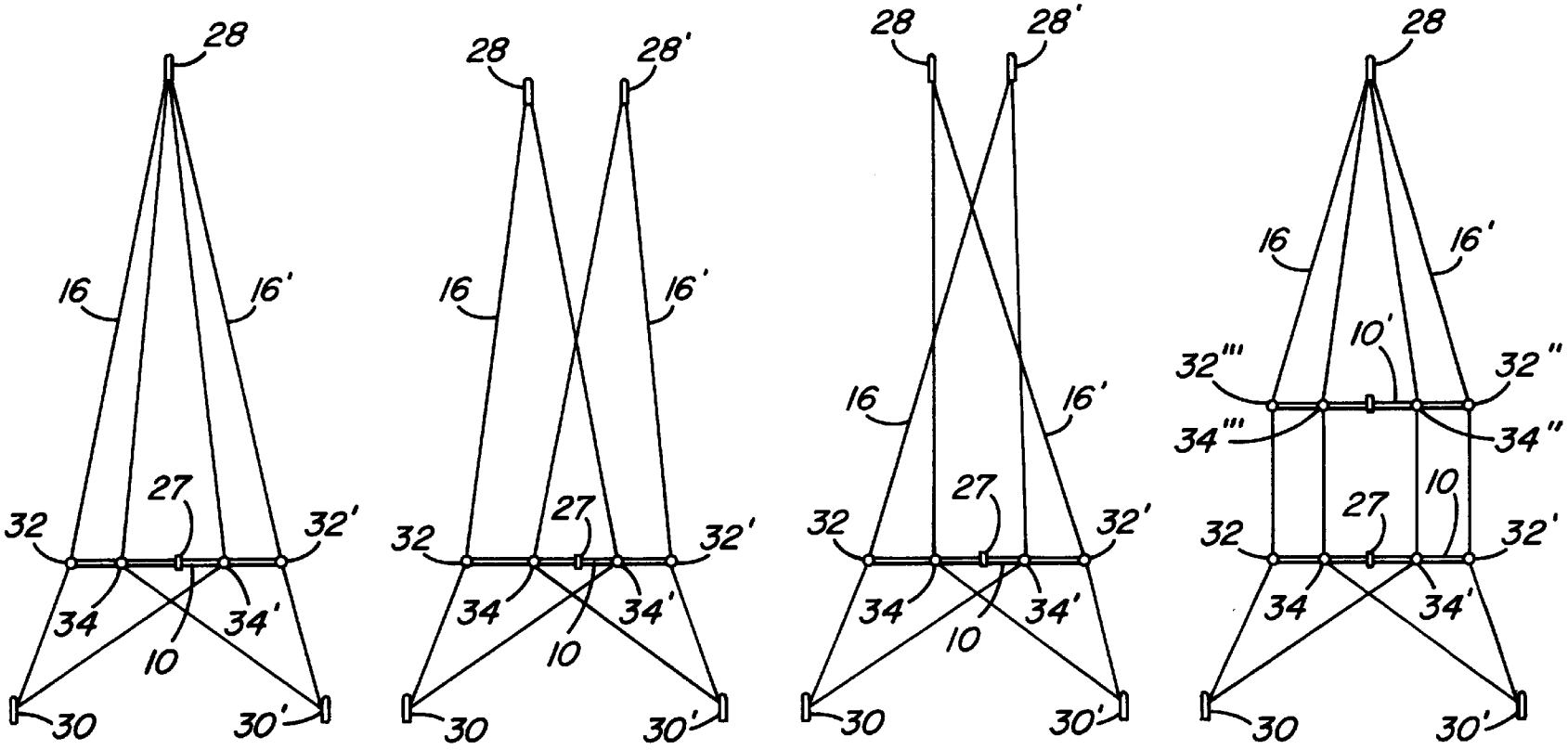
FIGS. 10(*a*)–(*d*) illustrate alternative arrangements of the cords.

As shown in FIGS. 10(*a*) through (c), there are several different manners in which the cords 16 may be strung. In FIG. 10(*a*), one loop of cord 16 is attached to a bow cleat 28, stern cleat 30, and collar 32 and 34', while the other loop of cord 16' is attached to cleat 28, cleat 30', and collars 32' and 34. In FIG. 10(*b*), cord 16 is strung between 28, 32, 30, and 34'. Cord 16' is strung between 28', 34, 30' and 32'. In FIG. 10(*c*), cord 16 is strung between 28', 32, 30, and 34'. Cord 16' is strung between 28, 34, 30', and 32'. In a further embodiment, as shown in FIG. 10(*d*), a plurality of transverse bars 10 having collars 32 and adjustable collars 34 may be employed for larger boats or heavier boat covers. Cord 16 is attached to 28, 32''', 32, 30, 34', and 34''. Cord 16' is attached to 28, 34''', 34, 30', 32', and 32''.

Figure 11:
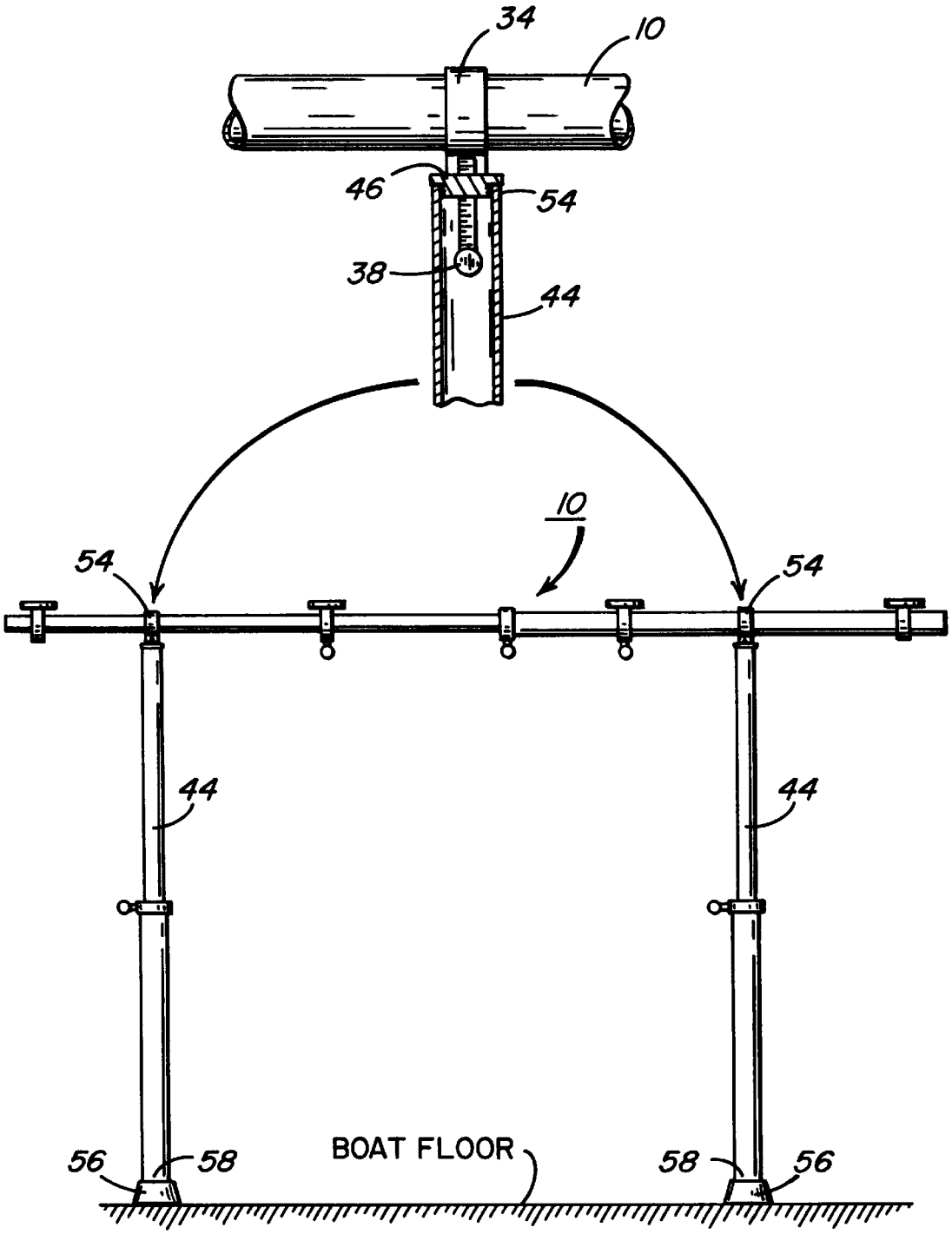
FIGS. 11(*a*)–(*b*) illustrate an alternate support assembly.

Support apparatus 10 should be sufficient in most circumstances to support a flexible cover which will not collapse or collect water and prevent weather damage to a boat. However, in climates where heavy snowfall can be expected, vertical supports 44 are provided as shown in FIGS. 11(*a*)–(*b*). A threaded flanged nut 46 is attached by fastener 38 through threaded hole 52 (not shown) in collar 34. An end 54 of a hollow extensible support post 44 is removeably secured over the extended thumbscrew 38 and is further stabilized upon mounting the flanged nut 46. Support post 44 may be made adjustable or may be trimmed to the appropriate length, as desired. Preferably, at least two extensible support posts 44, having protective coverings 56, preferably rubber, on at least one end 58, are employed to assist in supporting the support structure. The end 58 of the support posts 44 frictionally engages a surface of the boat and is supported by the boat. Vertical supports 44 may be used to provide an incline support if no windshield is present. The support structure 8 which is suitable for summer storage, or for winter storage in warmer climates, may be adapted to support heavy snowfalls in colder climates.

Although the present invention has been described in connection with preferred embodiments thereof, it will be appreciated by those skilled in the art that modifications, substitutions, deletions, and additions may be made without departing from the spirit and scope of the invention as defined in the appended claims.

I claim:

1. A support for a boat cover, comprising a bar adapted to be suspended across the transverse direction of a boat entirely by at least one cord, the at least one cord having sufficient length to extend to a bow and a stem of a boat.

2. A support for a boat cover as defined in claim 1 in which the bar is extensible.

3. The support for a boat cover as defined in claim 1 wherein the cords comprise a first and second cord of substantially equal length.

4. The support for a boat cover as defined in claim 3 wherein the bar further includes a plurality of collars spaced apart from one another and spaced apart from each end of the bar, each collar including a holder to prevent the lateral movement of adjacent longitudinal portions of the elastic cords along a length of the bar.

5. The support for a boat cover as defined in claim 1 wherein the bar has a length which is adjustable for accommodating boats of various widths.

6. The support for a boat cover as defined in claim 1 in combination with a boat having at least one bow cleat and at least one stern cleat, the bar being suspended entirely by the at least one cord over a cockpit of the boat in a transverse orientation, the at least one cord extending from the bar to at least one of the bow cleat and to at least one of the stern cleats.

7. The support for a boat cover as defined in claim 6 wherein the boat includes a windshield, the at least one cord extending to at least one of the bow cleat passing over a top of the windshield.

8. The support for a boat cover as defined in claim 4 in combination with a boat having at least one bow cleat and at least one stern cleat, the bar being suspended entirely by the at least one cord over a cockpit of the boat in a transverse orientation, wherein at least one cord is formed into a loop, the loop being stretched over the at least one bow cleat and at the least one stern cleat, the bar being removeably secured to a plurality of end collars and then subsequently to a plurality of inner collars.

9. The support for a boat cover as defined in claim 4 in which the plurality of collars may be adjustable.

10. The support for a boat cover as defined in claim 1 comprising two elastic cords.

11. The support for a boat cover as defined in claim 1 wherein the bar is comprised of at least two sections, a first coaxial tube section and a second coaxial tube section.

12. The support for a boat cover as defined in claim 1 wherein the bar is comprised of aluminum.

13. The support for a boat cover as defined in claim 11 wherein the bar is comprised of at least two sections, a first coaxial tube section and a second coaxial tube section.

14. A support for a boat cover, comprising a bar adapted to be suspended across the transverse direction of a boat entirely by at least one elastic cord, the at least one elastic cord having sufficient length to extend to a bow and a stern of a boat, wherein at least one elastic cord is formed into a loop, the loop being adapted to be stretched over at least one bow cleat and at least one stern cleat, the bar being removeably secured to a plurality of end collars and then subsequently to a plurality of inner collars.

15. The support for a boat cover as defined in claim 14 wherein the bar is comprised of aluminum.

16. The support for a boat cover as defined in claim 1 wherein the support comprises a plurality of bars.

17. The support for a boat cover as defined in claim 14 wherein the support comprises a plurality of bars.

18. The support for a boat cover in claim 1 in which the cord is elastic.

19. A support for a boat cover, comprising a bar adapted to be suspended across the transverse direction of a boat by at least one cord having sufficient length to extend to a bow and stern of a boat, and winter supports connected to and extending downward from the bar for further support of the bar.

20. The support of claim 19, wherein the at least one cord comprises a first and second cord of substantially equal length for suspension of the bar.

21. The support of claim 20, wherein the bar further includes a plurality of collars spaced apart from one another and spaced apart from each end of the bar, the winter supports extending downward from the collars, and further including holders attached to the collars to prevent lateral movement of adjacent longitudinal portions of the cords along a length of the bar.

* * * * *